US007055182B2

(12) United States Patent
Chiang

(10) Patent No.: US 7,055,182 B2
(45) Date of Patent: Jun. 6, 2006

(54) SWIMMING GOGGLES

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 14 days.

(21) Appl. No.: 10/895,053

(22) Filed: Jul. 21, 2004

(65) Prior Publication Data

US 2006/0015990 A1 Jan. 26, 2006

(51) Int. Cl.
*A61F 9/02* (2006.01)

(52) U.S. Cl. ..... 2/450

(58) Field of Classification Search ..... 2/428, 2/430, 440, 452, 450; 24/170
See application file for complete search history.

(56) References Cited

U.S. PATENT DOCUMENTS 6,691,377 B1 * 2/2004 Pan ..... 24/170
6,691,378 B1 * 2/2004 Chou ..... 24/170
6,832,394 B1 * 12/2004 Chiang ..... 2/428

* cited by examiner

*Primary Examiner*—Katherine M. Moran
(74) *Attorney, Agent, or Firm*—Troxell Law Office PLLC

(57) ABSTRACT

Swimming goggles comprises a left frame and a right frame retaining lenses therein, a connecting apparatus connecting the lens frames, and straps movably received in outward sides of the lens frames. Engaging blocks are respectively formed on outward sides of the lens frame. Adjusting apparatuses are assembled to the engaging blocks for adjusting straps. Each adjusting apparatus includes a base and a cover assembled together, and a fixing axis assembled on the base. A biasing arm and a button are transversely extended from the fixing axis with opposite for biasing stop grooves of the strap. An arcuate spring extends outwardly from each engaging block to provide the button with return force. Normally the strap can move only in a single direction. When the button is pressed downwardly, the biasing arm moves upwardly to disengage from a stop groove, correspondingly the strap can move in two directions.

11 Claims, 4 Drawing Sheets

SWIMMING GOGGLES

BACKGROUND OF THE INVENTION

1. Field of the Invention

The present invention relates to swimming goggles, and particularly to swimming goggles which have easily-adjustable straps and are conveniently used without taking off the swimming goggles 2. Related Art Conventional swimming goggles usually consist of a left frame, a right frame, a nose support, straps and adjusting fastener for positioning and adjusting the straps. In use, the conventional swimming goggles have to be taken down for adjusting the straps manually. It is often uneasy to adjust the straps appropriately only by a wearer's feeling. Thus, the swimming goggles have to be taken up and down more than one times to suit for the wearer, that is tedious and inconvenient.

SUMMARY OF THE INVENTION

Accordingly, an object of the present invention is to provide swimming goggles allowing the wearer to conveniently adjust the length of a head strap thereof one time only without taking off the swimming goggles, so that the actual requirement of the wearer may be met in use.

The swimming goggles comprise a left frame and a right frame connected together. Engaging blocks are respectively formed on outward sides of the left frame and the right frame. Adjusting apparatuses are assembled to the engaging blocks for adjusting straps. Each adjusting apparatus includes a base and a cover assembled together, and a fixing axis. An axis hole is defined in the base for pivotably receiving the fixing axis. A biasing arm is transversely extended from the fixing axis for abutting against stop grooves of the strap. A button is transversely extended from the fixing axis and is assembled with the biasing arm for manual operation. An arcuate spring extends outwardly from a side edge of each engaging block. Normally the strap can move only in a single direction. When the button is pressed downwardly, the biasing arm moves upwardly to disengage from the stop grooves, and the strap can move in two directions. When pressure to the button is removed, the arcuate spring drives the button to return.

DESCRIPTION OF THE PREFERRED EMBODIMENTS

Figure 1:
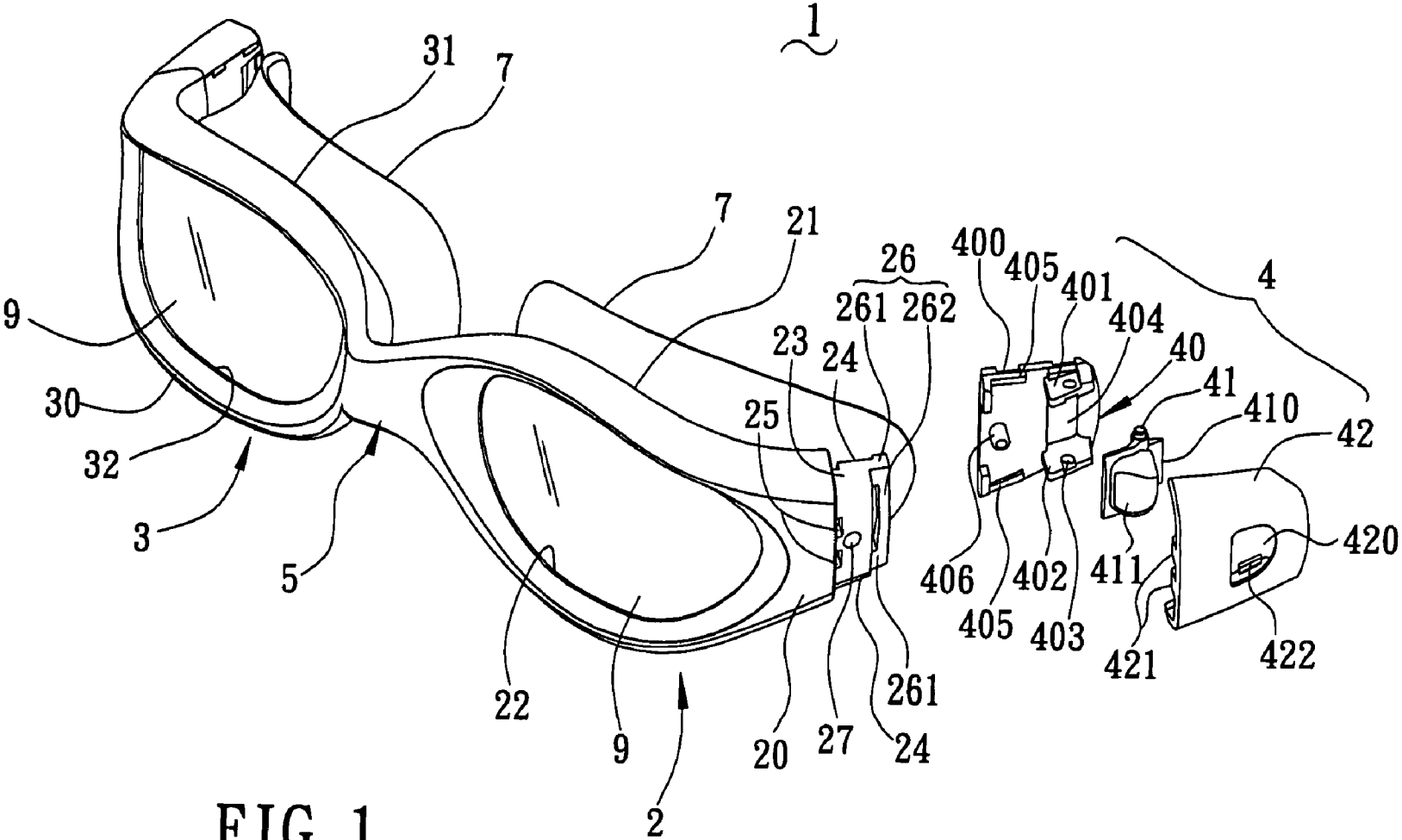
FIG. 1 is an perspective view of swimming goggles of the present invention, wherein an adjusting apparatus of the swimming goggles is separated from the swimming goggles and is exploded.
Figure 5:
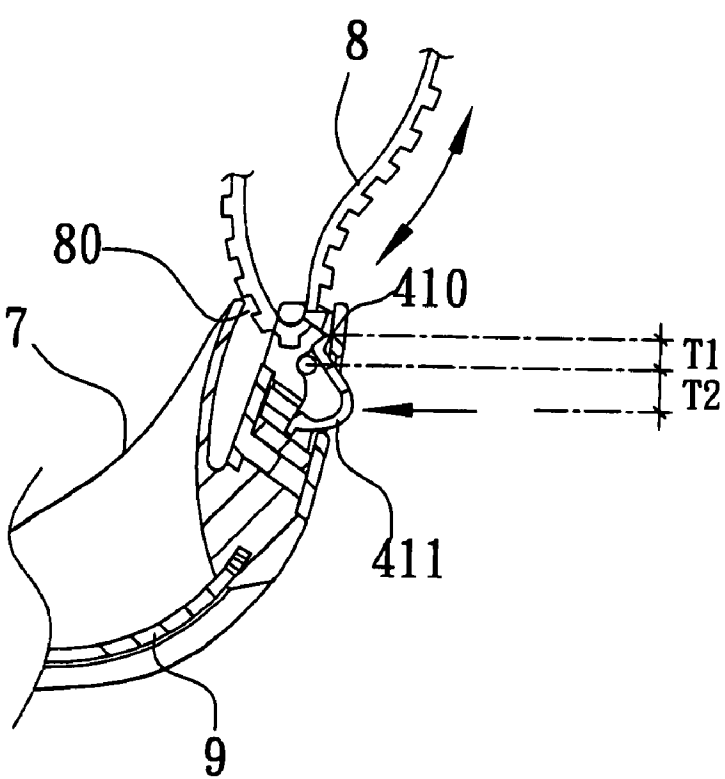
FIG. 5 is similar to FIG. 4 except that a button of the adjusting apparatus is pressed.
Figure 4:
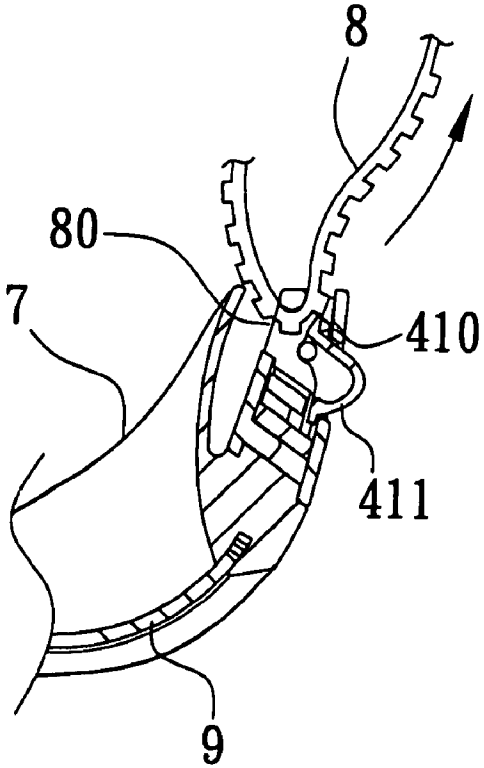
FIG. 4 is a cross-sectional and partial view taken along the line 4—4 in FIG. 3.

With reference to FIG. 1, swimming goggles 1 in accordance with the present invention comprise a left frame 2, a right frame 3, a connecting apparatus 5, pads 7, adjusting apparatuses 4 and straps 8 (shown in FIGS. 4 and 5). In one embodiment, the connecting apparatus 5 is a nose support. The left frame 2, the right frame 3, the connecting apparatus 5 and the pads 7 are integrally formed of soft material. The left frame 2 and the right frame 3 respectively have outer surfaces 20, 30 and inner surfaces 21, 31. Receiving passageways 22, 32 are respectively defined between the outer surfaces 20, 30 and the inner surfaces 21, 31 for accommodating lens 9. The lens 9 are unitarily embedded between the outer surfaces 20, 30 and the inner surfaces 21, 31 during manufacturing of the left frame 2 and the right frame 3. The pads 7 are integrally formed on the inner surfaces 21, 31 of the left frame 2 and the right frame 3. Engaging blocks 23 are respectively formed on outward sides of the left frame 2 and the right frame 3. Each engaging block 23 has a first engaging portion (not labeled) and a second engaging portion (not labeled). In one embodiment, the first engaging portion includes L-shaped jags 24 respectively in upward and downward edges of the engaging block 23. The second engaging portion includes positioning grooves 25 respectively adjacent to the left frame 2 and the right frame 3. An arcuate spring 26 respectively extends outwardly from a side edge of each engaging block 23. The arcuate spring 26 comprises two short sides 261 connecting with the engaging block 23, and a long side 262. The long side 262 transversely connects with ends of the short sides 261 and is arcuate for providing resiliency. An engaging hole 27 is defined in the engaging block 23.

Each adjusting apparatus 4 comprises a base 40, a fixing axis 41 and a cover 42. The base 40 has a first base wall 401, and a second base wall 402 opposing to each other. An axis hole 403 is defined respectively through the first base wall 401 and the second base wall 402 for pivotably receiving the fixing axis 41. A strap hole 404 is defined between the first base wall 401 and the second base wall 402 and adjacent the axis hole 403 for movably receiving the strap 8. The adjusting apparatus 4 further comprises an embedding portion for engaging with the engaging block 23. In one embodiment the embedding portion has L-shaped projections 405 on the base 40 for engaging the L-shaped jags 24 of the engaging block 23. The base 40 forms a reinforce post 406 between the L-shaped projections 405 for cooperating with the engaging hole 27 of the engaging block 23. The base 40 further defines locking holes 400 in sides thereof.

The fixing axis 41 is pivotably received in the axis hole 403. A biasing arm 410 is transversely extended from the fixing axis 41 for biasing stop grooves 80 (shown in FIGS. 4 and 5) of the strap 8. A button 411 is transversely extended from the fixing axis 41 and is assembled with the biasing arm 410. The button forms an inclined surface at a side thereof for facilitating manual operation. Notably, further referring to FIG. 5, the distance T2 between the fixing axis 41 and the tip of the inclined surface of the button 411 and is larger than the distance T1 between the fixing axis 41 and an extreme end of the biasing arm 410. Thus, the fixing axis 41 acting as fulcrum, the button 411 is easily pressed to drive the biasing arm 410 to move complying with leverage principle.

The cover 42 is fixed on the base 40 in assembly. The cover 42 defines a through hole 420 for receiving the button 411, and forms a plurality of barbs 421 at an edge thereof for locking the positioning grooves 25 of the engaging block 23. The cover 42 further forms locking posts 422 at sides thereof for cooperating with the locking holes 400 of the base 40.

Figure 2:
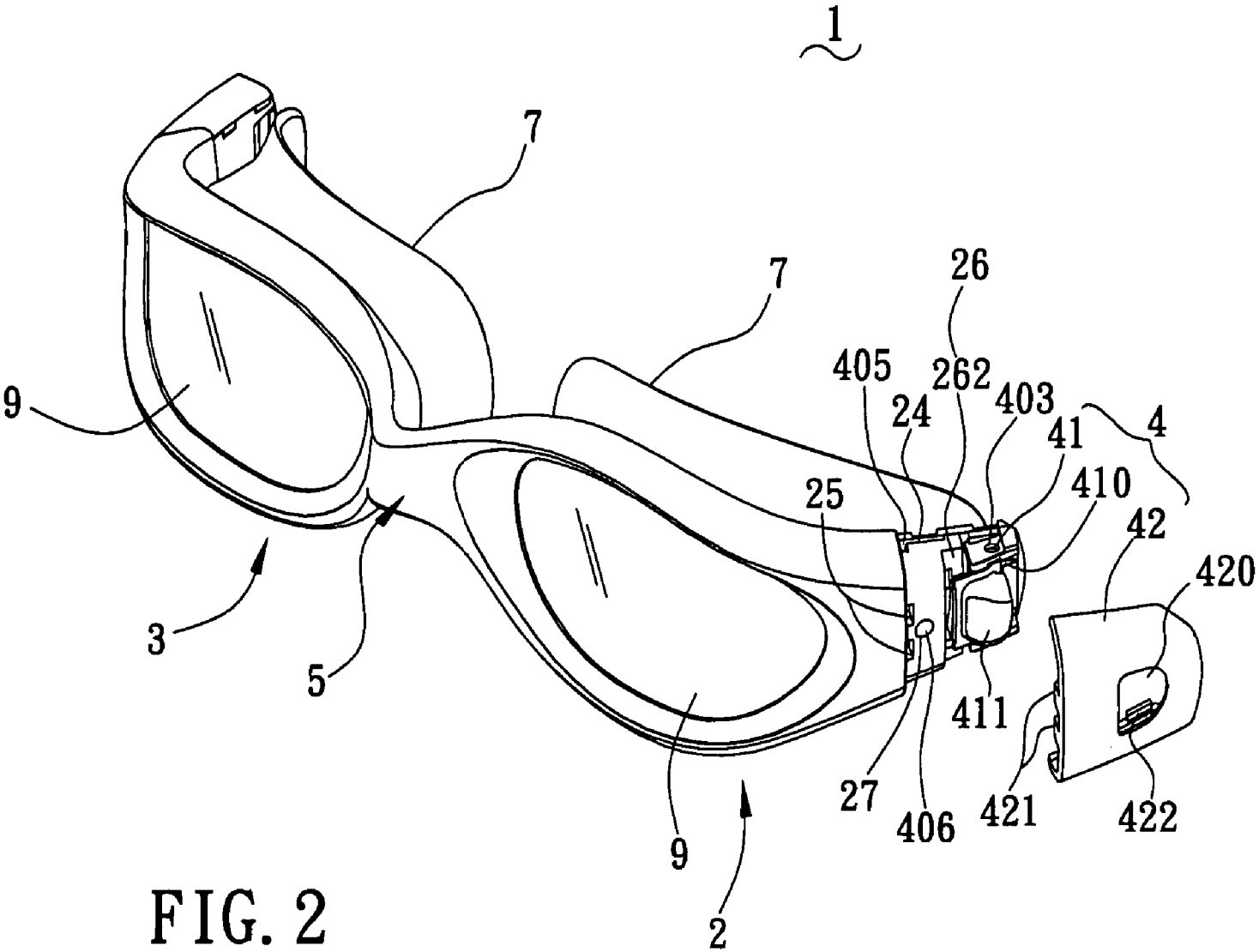
FIG. 2 is a perspective view of the swimming goggles of FIG. 1, wherein a cover of the adjusting apparatus is separated from the swimming goggles.
Figure 3:
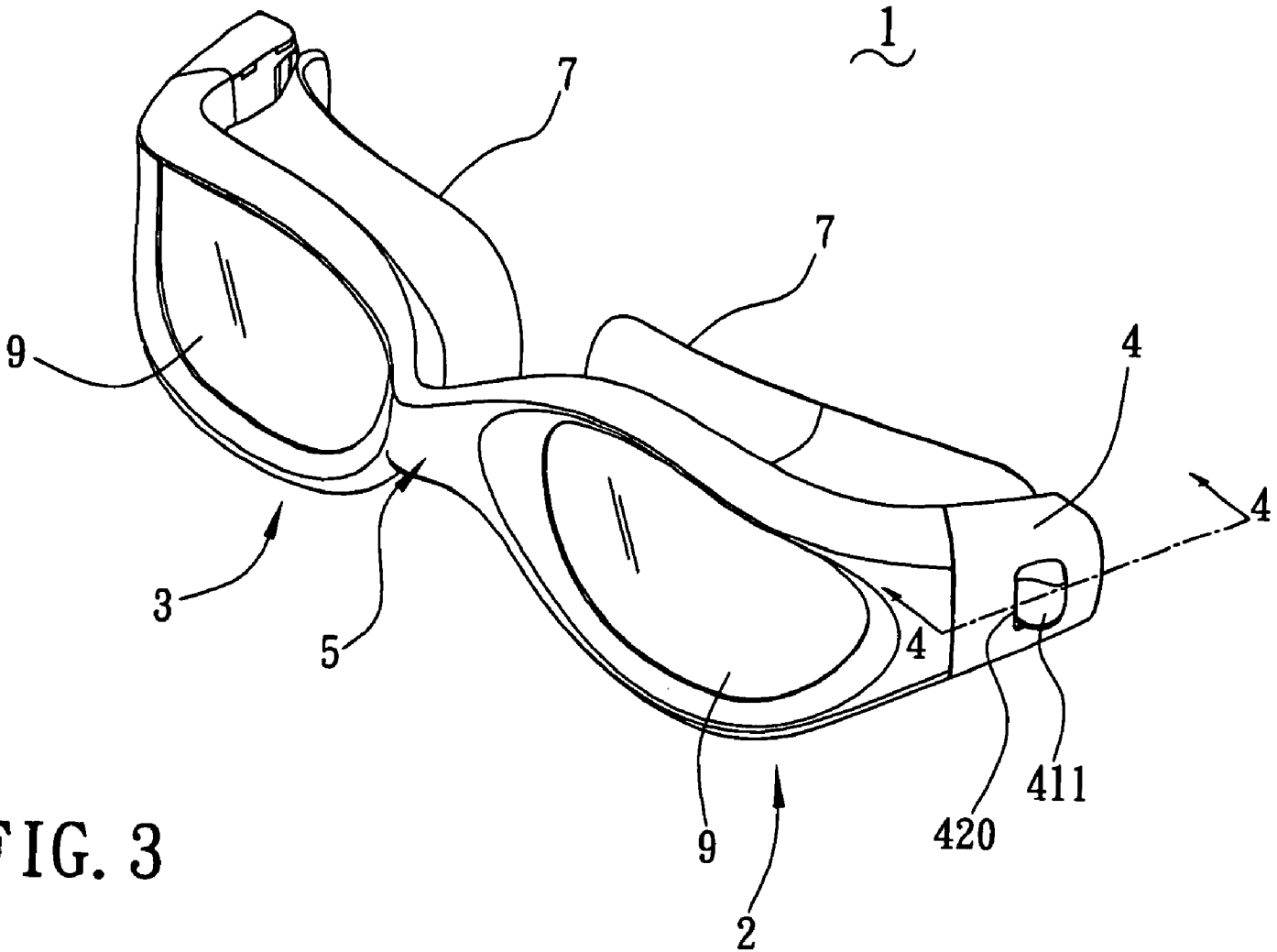
FIG. 3 is an assembled view of the swimming goggles of FIG. 1.

In combination with FIGS. 1-3, during manufacturing, the lens 9 are integrally embedded into the left frame 2 and the right frame 3, and unitarily formed with the connecting apparatus 5 and the pads 7. Preferably, height of the engaging blocks 23 are smaller than height of the left frame 2 and the right frame 3, and the adjusting apparatus 4 have tops and bottoms respectively aligning with tops and bottoms of the left frame 2 and the right frame 3 when the adjusting apparatus 4 are assembled to the swimming goggles 1. In FIGS. 1–3, only an adjusting apparatus 4 is an example for clear description of assembly. The fixing axis 41 is assembled onto the axis hole 403. The button 411 is oriented beyond the long side 262 of the arcuate spring 26. The L-shaped projections 405 latch with the L-shaped jags 24. The reinforce post 406 is extended into the engaging hole 27. The engaging posts 422 lock with the locking holes 400, whereby the cover 42 is assembled onto the base 40.

As shown in FIG. 4, the strap 8 are extended through the strap hole 404. The biasing arm 410 abuts against a stop groove 80 of the strap 8, wherein the strap 8 can move only in a single direction (as arrow shown in FIG. 4). In other words, a user only can pull the strap 8 tighter at this state. Referring to FIG. 5, the button 411 is pressed downwardly. Correspondingly, the biasing arm 410 moves upwardly to disengage from the stop groove 80. Meanwhile the long side 262 of the arcuate spring 26 is deformed and reserves energy. At this state, the strap 8 can move in two directions (as arrow shown in FIG. 5), in other words, a user only can freely pull the strap 8 tighter or looser. When pressure to the button 411 is removed, the arcuate spring 26 drives the button 411 to return, and then the biasing arm 410 abuts against a stop groove 80 of the strap 8 again.

The user makes the straps 8 looser before wearing the swimming goggles, and then pulls the straps 8 directly and easily for proper positioning when wearing. On the other hand, when wearing, the user can press the button 411 to make the straps 8 move a certain of length, and then pulls the straps 8 to a proper position.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

a left frame and a right frame connected together by a connecting apparatus, the left and the right frames respectively having an outer surface and an inner surface, receiving passageways being defined between the outer surfaces and inner surfaces of the left and the right frames for accommodating lens, engaging blocks being respectively formed on outward sides of the left frame and the right frame, each engaging block having a first engaging portion and a second engaging portion, an arcuate spring extending outwardly from a side edge of each engaging block; and at least an adjusting apparatus assembled to the engaging blocks, and each adjusting apparatus including:

a base having a first base wall and a second base wall opposing each other, an axis hole being defined respectively through the first base wall and the second base wall, a strap hole being defined between the first base wall and the second base wall and adjacent the axis hole for movably receiving a strap, en embedding portion being formed on the base for engaging with the first engaging portion of the engaging block;

a fixing axis pivotably received in the axis hole, a biasing arm transversely extending from the fixing axis for biasing stop grooves of the strip, and a button transversely extending from the fixing axis and assembled to the biasing arm for manual operation; and a cover assembled with the base, and defining a through hole for receiving the button and forming a plurality of barbs thereon for locking the second engaging portion of the engaging block.

2. The swimming goggles as claimed in claim 1, wherein height of the engaging blocks are smaller than height of the left frame and the right frame, and the at least one adjusting apparatus has tops and bottoms respectively aligning with tops and bottoms of the left frame and the right frame when the at least one adjusting apparatus is assembled to the swimming goggles.

3. The swimming goggles as claimed in claim 1, wherein the arcuate spring comprises two short sides connecting with the engaging block, and a long side transversely connecting with ends of the short sides and being arcuate for providing resiliency.

4. The swimming goggles as claimed in claim 1, wherein the first engaging portion includes L-shaped jags respectively in upward and downward edges of the engaging block, and wherein the embedding portion includes a pair of L-shaped projections for latching the L-shaped jags.

5. The swimming goggles as claimed in claim 1, wherein the second engaging portion includes positioning grooves respectively adjacent to the left frame and the right frame for cooperating with the barbs of the cover.

6. The swimming goggles as claimed in claim 4, wherein an engaging hole is defined in the engaging block, and wherein the base forms a reinforce post between the L-shaped projections for cooperating with the engaging hole.

7. The swimming goggles as claimed in claim 1, wherein the base further defines locking holes in opposite sides thereof, and wherein the cover further forms locking posts at sides thereof for cooperating with the locking holes.

8. The swimming goggles as claimed in claim 1, wherein the button has an inclined surface for facilitating manual operation.

9. The swimming goggles as claimed in claim 1, wherein the distance between the fixing axis and the tip of the inclined surface of the button and is larger than the distance between the fixing axis and an extreme end of the biasing arm.

10. The swimming goggles as claimed in claim 1, wherein the connecting apparatus is a nose support, and the nose support is integrated with the left frame and the right frame.

11. The swimming goggles as claimed in claim 1, wherein pads are integrally formed on the inner surfaces of the left frame and the right frame, and wherein the left frame, the right frame, the connecting apparatus and the pads are integrally formed of soft material.

* * * * *